United States Patent [19]

Lowe

[11] 4,192,108

[45] Mar. 11, 1980

[54] FRAMELESS METAL BUILDING

[76] Inventor: Colin F. Lowe, P.O. Box 128, Hutsonville, Ill. 62433

[21] Appl. No.: 911,378

[22] Filed: Jun. 1, 1978

Related U.S. Application Data

[63] Continuation-in-part of Ser. No. 831,781, Sep. 9, 1977, Pat. No. 4,106,245.

[51] Int. Cl.[2] ..... E04B 7/02

[52] U.S. Cl. ..... 52/90; 52/278; 52/282; 52/537; 52/795

[58] Field of Search ..... 52/276–278, 52/282, 521, 537, 588, 90, 46, 648, 695, 795, 814

[56] References Cited

U.S. PATENT DOCUMENTS

| | | | |
|---|---|---|---|
| 1,447,966 | 3/1923 | Davidson | 52/278 X |
| 1,840,041 | 1/1932 | Kellogg | 52/90 |
| 2,023,814 | 12/1935 | Lindsey | 52/90 |
| 2,175,653 | 10/1939 | Williams | 52/278 X |
| 2,180,486 | 11/1939 | Tench | 52/695 |
| 2,439,095 | 4/1948 | Mitchell | 52/278 X |
| 2,480,699 | 8/1949 | Black | 52/276 |
| 2,742,114 | 4/1956 | Behlen | 52/630 X |
| 3,064,771 | 11/1962 | Behlen | 52/245 |
| 3,156,070 | 11/1964 | Mesnager | 52/18 |
| 3,203,145 | 8/1965 | Raynes | 52/90 X |
| 3,227,062 | 1/1966 | Andersson | 52/93 X |
| 3,308,596 | 3/1967 | Cooper et al. | 52/630 |
| 3,492,765 | 2/1970 | Behlen | 52/630 X |
| 3,500,596 | 3/1970 | Anderson | 52/79.7 |
| 3,657,849 | 4/1972 | Garton | 52/90 |
| 3,959,942 | 6/1976 | Merson | 52/551 |
| 3,968,603 | 7/1976 | Merson | 52/86 |
| 4,106,245 | 8/1978 | Lowe | 52/90 |

FOREIGN PATENT DOCUMENTS

| | | | |
|---|---|---|---|
| 214576 | 7/1956 | Australia | 52/90 |
| 467209 | 10/1928 | Fed. Rep. of Germany | 52/537 |
| 216083 | 10/1967 | Sweden | 52/90 |
| 976927 | 12/1964 | United Kingdom | 52/277 |

*Primary Examiner*—Alfred C. Perham
*Attorney, Agent, or Firm*—Jacox & Meckstroth

[57] ABSTRACT

A series of rectangular roof panels and rectangular wall panels each include inner and outer corrugated sheet metal skins which are rigidly secured by fasteners to opposite sides of formed sheet metal longitudinally extending spacer members rigidly connected by formed sheet metal laterally extending spacer members. The inner skins and spacer members of the roof panels are rigidly connected across a ridge portion to transmit tension forces. The outer skins and spacer members of the roof panels form a pitch of less than twelve degrees and are rigidly connected across the ridge portion for transmitting compression forces. Inner attachment plates and fasteners rigidly connect the inner skins and spacer members of the roof panels to the inner skins and spacer members of the wall panels, and the spacer members of the roof panels are also rigidly connected to the outer skins and spacer members of the wall panels to form a building structure which has substantial total strength and can be easily and quickly erected without the use of a crane. In one embodiment, the roof panels are connected at the ridge by an upper tapered wedge member and a ridge beam disposed below the panels, and in another embodiment, a ridge beam is disposed between the panels. The roof and wall panels are constructed either with parallel skins or with tapering spacer members forming non-parallel skins. The spacer members within the roof panels may also be formed with open lattice-type crossing struts for minimizing weight in larger roof panels.

24 Claims, 18 Drawing Figures

FRAMELESS METAL BUILDING

RELATED APPLICATION

This application is a continuation-in-part of U.S. application Ser. No. 831,781, filed Sept. 9, 1977, now U.S. Pat. No. 4,106,245.

BACKGROUND OF THE INVENTION

In the art of metal buildings, it is common to use a steel frame which provides for a low roof pitch and for resisting the loads on the building. Parallel spaced roof purlins and parallel spaced wall girts are secured to the frame, and corrugated sheet metal skins or panels are attached to the outer surfaces of the roof purlins and wall girts to form the outer covering or shell for the building. Usually the outer metal skin or sheet metal panels are corrugated in order for the panels to span the spaces between adjacent roof purlins and wall girts, but the frame supports substantially the entire static, wind and snow loads on the metal building.

There have been attempts to construct metal buildings without a metal frame, purlins and girts and to use the inherent strength of corrugated roof and wall panels to withstand the various loads on the building. Examples of such building constructions are disclosed in U.S. Pat. Nos. 2,742,114 and 3,492,765. It has also been proposed to construct a metal building without the use of purlins and girts by erecting a frame and attaching to the frame heavy corrugated sheet metal panels, for example, as disclosed in U.S. Pat. No. 3,308,596. The construction of a metal building has also been proposed from prefabricated roof and wall panels each of which includes inner and outer corrugated sheet metal skins tied together by parallel spaced bars and with an insulation material confined between the inner and outer skins, for example, as disclosed in U.S. Pat. No. 3,500,596.

SUMMARY OF THE INVENTION

The present invention is directed to an improved sheet metal building structure formed of prefabricated sheet metal panels constructed and assembled in a manner which provides for substantially high total strength and thus high resistance to wind and snow loads, and which eliminates the need for a metal frame, roof purlins and wall girts. In addition, the metal building of the present invention significantly reduces the total time and cost for constructing and erecting a metal building and, in addition, eliminates the need for a crane to erect the building. The construction of the prefabricated sheet metal panels and the manner by which the panels are coupled together further provides for fast, simple and accurate erection of a metal building and utilizes the inherent strength of the sheet metal inner and outer skins of the panels to support or carry substantially the entire loads which are applied to the building as a result of various weather conditions.

Other features and advantages of the invention will be apparent from the following description, the accompanying drawings and the appended claims.

DESCRIPTION OF THE PREFERRED EMBODIMENTS

Figure 1:
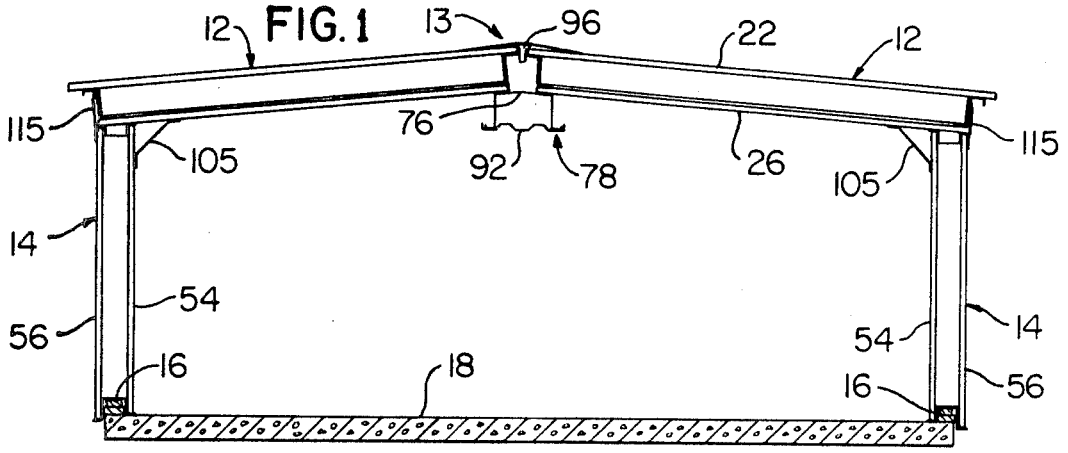
FIG. 1 is an end elevational view of a sheet metal building constructed in accordance with the invention and with the end walls removed.

A metal building constructed in accordance with the invention has an end view as generally illustrated in FIG. 1 and includes a plurality of prefabricated rectangular roof panels 12 which are arranged at a pitch of less than twelve degrees, for example, five degrees, and are coupled together along the center ridge 13 of the building. The assembled roof panels are coupled together and supported by a plurality of prefabricated rectangular side wall panels 14 and end wall panels (not shown). The vertical side and end wall panels seat upon base floor plates 16 which are bolted to the outer edges of a concrete slab floor 18.

Figure 2:
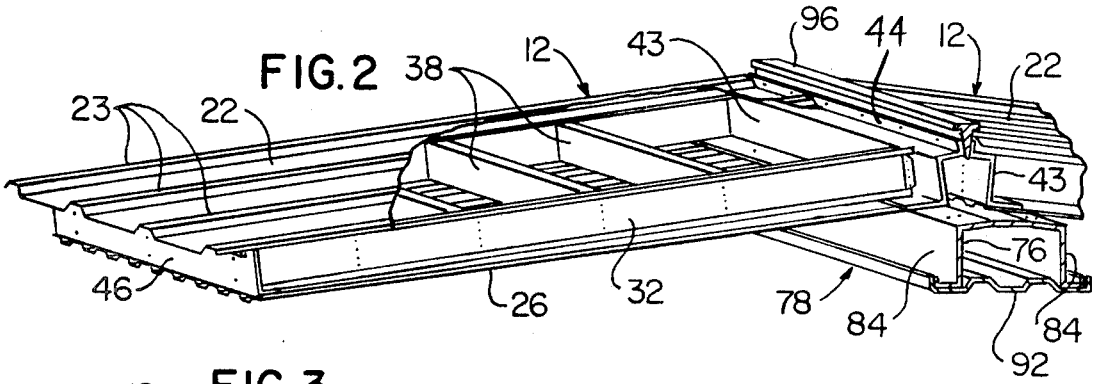
FIG. 2 is a fragmentary perspective view of two opposing roof panels used in the building shown in FIG. 1 and illustrating the system for coupling the roof panels along the ridge of the building.
Figure 7:
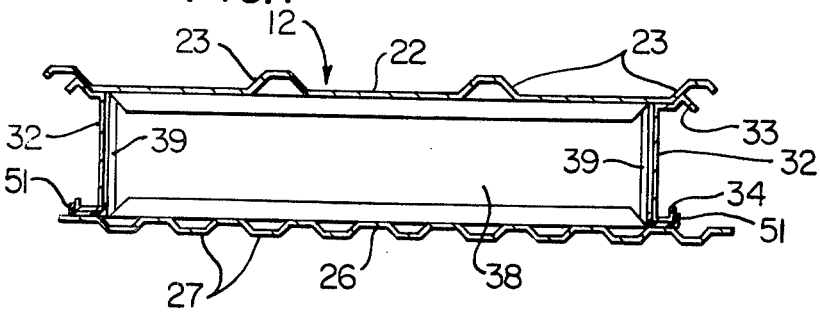
FIG. 7 is an enlarged cross-section of a typical roof panel shown in FIG. 2.

Each of the prefabricated roof panels 12 is constructed of formed sheet metal and includes an upper or outer sheet metal skin 22 (FIGS. 2 and 7) having parallel spaced roll-formed ribs 23. Each roof panel 12 also includes a lower or inner sheet metal skin 26 (FIG. 7) which forms an inner liner for the building and also has parallel spaced ribs 27 to provide a corrugated cross-sectional configuration. As illustrated in FIG. 1, the thicknesses of the roof panels 12 and the wall panels 14 are somewhat exaggerated relative to the size of the metal building.

The roll-formed sheet metal skins 22 and 26 of each roof panel 12 are rigidly secured by blind rivets or other fastening means to parallel spaced longitudinally extending spacer members 32 (FIG. 7) which are formed of sheet metal and have generally a channel-shaped configuration. The upper flange of each spacer member 32 has a V-shaped rib portion 33 which is secured by rivets or other fastening means such as screws or welds to an adjacent rib 23 of the overlying outer skin 22, and the lower flange of each spacer member 32 has an inwardly projecting return rib portion 34 and is secured by rivets to the inner sheet metal skin 26.

Figure 4:
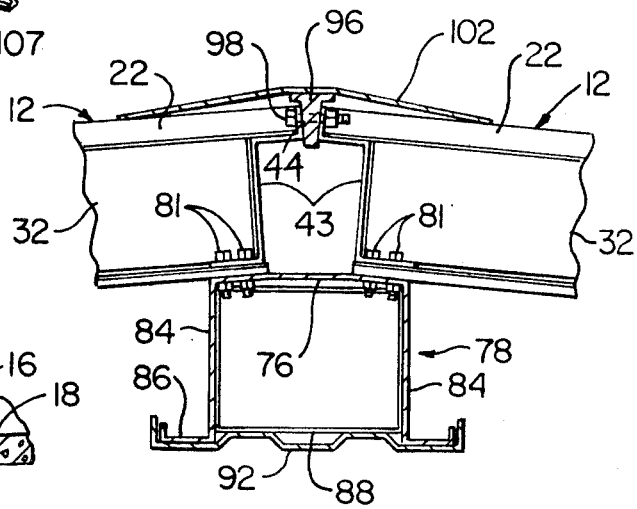
FIG. 4 is an enlarged vertical section through the ridge portion of the building shown in FIG. 1.

The longitudinally extending spacer member 32 of each roof panel 12 are rigidly connected by laterally extending spacer members 38 (FIGS. 2 and 7) each of which is also formed of sheet metal and has opposite end flanges 39 (FIG. 7) secured to the spacer members 32. The upper and lower flanges of each laterally extending spacer member 38 has inwardly projecting rib portions 41. The upper or inner ends of the longitudinally extending spacer members 32 of each roof panel 12 are also rigidly secured by a ridge spacer member 43 (FIG. 4) which has generally a Z-shaped cross-sectional configuration with an upwardly projecting flange 44. The outer or lower ends of the longitudinally extending spacer members 32 of each roof panel 12 are rigidly connected by an eve spacer member 46 (FIG. 5) which also has a Z-shaped cross-sectional configuration and includes a downwardly projecting return lip portion 47. All of the spacer members 32, 38, 43 and 46 of each roof panel 12 are formed of sheet metal and are rigidly secured to the upper or outer skin 22 and lower or inner skin 26 to form, in effect, a box beam. A channel shaped strip 51 (FIGS. 5 and 7) of thermal insulation material is sandwiched between the lower surfaces of each of the spacer members and the inner skin 26 to avoid any significant heat transfer between the inner skin 26 and the outer skin 22.

Figure 3:
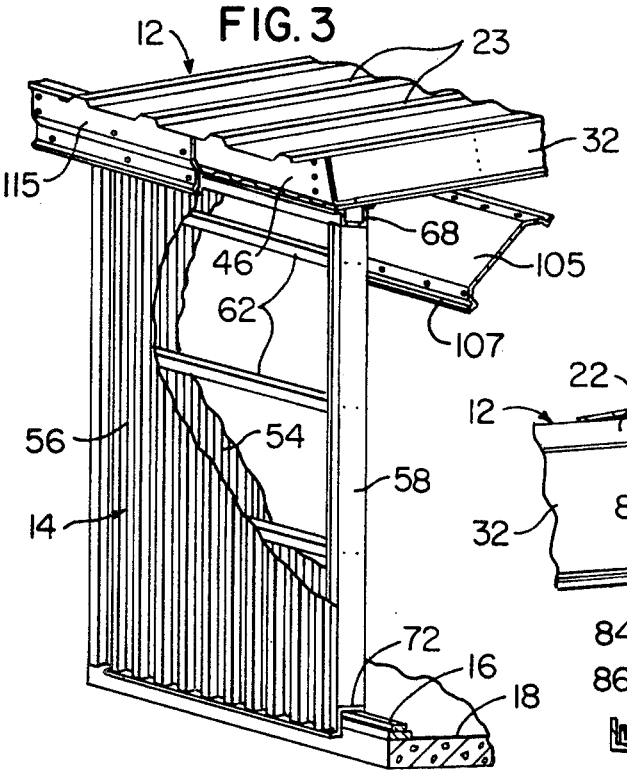
FIG. 3 is a fragmentary perspective view of the wall and roof panels used in the building shown in FIG. 1 and illustrating the coupling of the roof panels to the wall panels.
Figure 8:
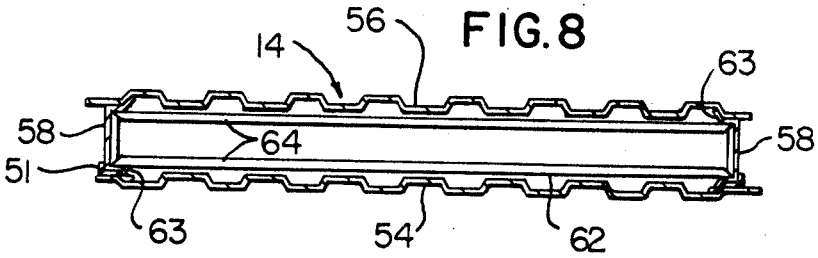
FIG. 8 is an enlarged cross-section of a typical wall panel as shown in FIG. 3.

Each of the side wall panels 14 is constructed or fabricated substantially the same as the roof panels 12. Thus referring to FIGS. 3 and 8, a rectangular wall panel 14 includes a corrugated or ribbed inner sheet metal skin 54 and a ribbed sheet metal outer skin 56 which are secured to a set of vertical or longitudinally extending sheet metal spacer members 58. The spacer members 58 are rigidly connected by horizontal or laterally extending sheet metal spacer members 62. As shown in FIG. 8, each of the longitudinally extending spacer members 58 has generally a channel-shaped configuration with outwardly projecting lip portions 63 which are riveted to the roll-formed inner and outer skins. Each of the laterally extending spacer members 62 is constructed similar to the spacer members 38 and has inwardly projecting return lip portions 64. The spacer members 62 also have end flanges 66 which are secured to the parallel spaced longitudinally extending spacer members 58 of the wall panel.

Figure 5:
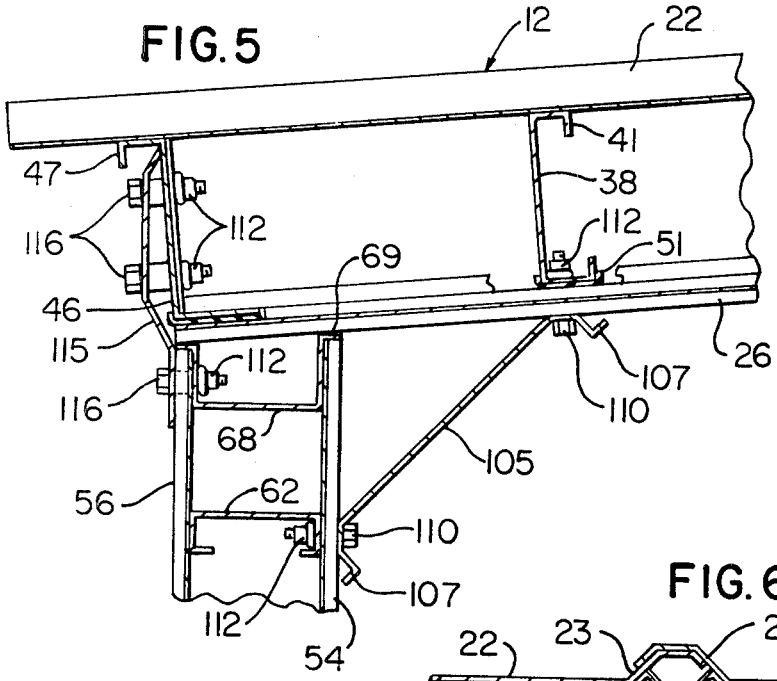
FIG. 5 is an enlarged vertical section through an eve portion of the building shown in FIG. 1.

Referring to FIG. 5, the upper ends of the inner and outer skins of the wall panels 14 forming each side wall are rigidly connected by a channel-shaped horizontal spacer member 68 which has outwardly projecting lip portions 69 overlying the upper ends of the inner and outer skins 54 and 56. The top spacer member 68 is formed in sections and extends continuously the full length of the building and cooperates to align the wall panels. A similarly shaped channel-like spacer member 72 (FIG. 3) rigidly secures the lower end portions of the inner and outer skins of each wall panel 14 and receives the plate member 16 secured to the floor 18. While not shown, the end wall panels for the metal building are constructed substantially the same as the side wall panels 14, except that the end wall panels have a greater length or height and have upper ends which conform to the pitch of the building roof. One or both of the end walls may be provided with a large door opening according to the ultimate use of the metal building.

Figure 6:
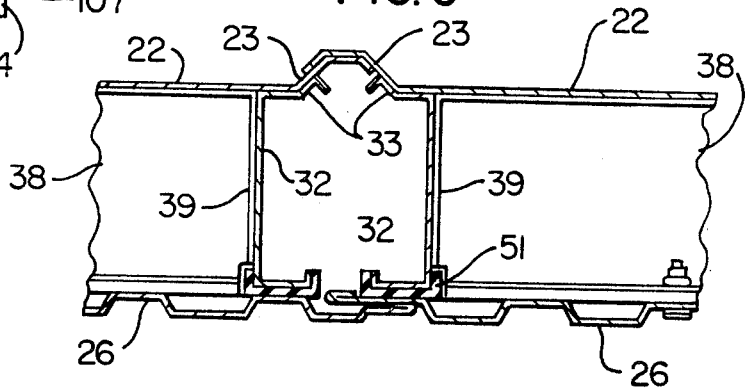
FIG. 6 is an enlarged fragmentary section showing the assembled relation of two adjacent roof panels.

In the erection of a metal building in accordance with the invention, two or more side wall panels 14 are placed upon the floor plate 16 on each side of the building, and the overlapping skins of the wall panels are secured together by fasteners such as screws or blind rivets. The wall panels for one end of the building are also erected and connected to each other and to the adjacent side wall panels 14 at the corners of the building. A set of opposing roof panels 12 are positioned in place, and the inner end portions of the roof panels 12 are rigidly connected by the top plate or ridge member 76 (FIG. 4) of a ridge beam 78. The connection is formed by a set of bolts 81 which are longitudinally spaced along the ridge spacer member 43 and extend through the ridge spacer member and lower roof skin 26 of each roof panel 12 in addition to the ridge beam plate 76. Some of the bolts 81 also extend through the longitudinal spacer members of each roof panel. Thus the bolts 81 and plate 76 form a rigid connection between each set of opposing roof panels 12 along the ridge 13 and provide for transmitting substantial tension forces between the roof panels across the ridge. The next pair of opposing roof panels 12 are assembled, and the skins of adjacent roof panels overlap as shown in FIG. 6. The overlapping ribs of the skins are secured together by fasteners such as screws and/or blind rivets.

The ridge beam 78 also includes downwardly projecting side walls 84 (FIG. 4) and outwardly projecting bottom flanges 86, and is constructed in longitudinal sections which are coupled together as the erection of the building progresses from one end of the building towards the opposite end. The side walls 84 of the ridge beam 78 are also coupled together at longitudinally spaced intervals by rectangular ridge beam spacers 88 which are also formed of sheet metal and are secured to the side walls by rivets. The ridge beam 78 is also connected to opposite end walls of the building, and after the building is erected and the bolts 81 are completely tightened, a bottom sheet metal ridge beam cover 92 is secured to the bottom flanges 86 and cooperates to complete the ridge beam 78 in the form of a box beam.

After all of the roof panels 12 are erected and coupled together by the top plate 76 of the ridge beam 78, and the outer end portions of the roof panels 12 are coupled to the side walls 14, as will be explained later, a tapered wedge member 96 (FIG. 4) is inserted between the upwardly projecting flanges 44 of the ridge spacer members 43 of the roof panels 12, and sections of the wedge member 96 extend continuously the full length of the building. After the wedge member 96 is positioned so that it forms a snug fit between the flanges 44, the wedge member 96 is drilled with holes which align with preformed holes within the flanges 44, and a series of bolts 98 are inserted through the holes to secure the wedge member in place. Thus the wedge member 96 functions to transfer compression forces between the upper or outer skins 22 of opposing sets of roof panels 12 across the ridge 13 and also functions to compensate for accumulated tolerance in the manufacture and assembly of the roof panels. A ridge cover plate 102 is placed over the wedge member 96 and is secured by screws to the outer skins 22 of the roof panels 12.

Referring to FIG. 5, the outer end portion of each roof panel 12 seats upon the upper header and spacer member 68 which connects the upper ends of the side walls panels 14 of each side wall. An inner attachment plate 105 slopes at an angle of approximately 45 degrees degrees between the inner skins of the roof panels 12 and wall panels 14, and the inner attachment plate 105 is formed in longitudinal sections in a manner similar to the ridge beam 78 and wedge member 96. V-shaped ribs 107 are formed along opposite edge portions of each attachment plate 105 for purpose of reinforcement, and the attachment plates may be ribbed or corrugated at longitudinally spaced intervals to provide additional compression strength.

The upper edge portion of each attachment plate 105 is rigidly secured to the roof panels 12 by a series of longitudinally spaced screws 110 each of which is threaded into a preassembled nut 112, preferably in the form of a "Rivnut" manufactured and marketed by The B. F. Goodrich Company. Each "Rivnut" extends through the inner skin 26 and a laterally extending spacer member 38 and secures these components together. Some of the "Rivnuts" also extend through the longitudinally extending spacer members 32 of the roof panels.

The lower edge portion of each inner attachment plate 105 is also rigidly connected to the side wall panels 14 by another set of screws 110. Each screw is threaded into an aligned "Rivnut" fastener 112 which connects with the uppermost laterally extending or horizontal spacer member 62 of each wall panel. Some of the fasteners also connect with the overlapping portions of the longitudinally extending or vertical spacer members 58.

As also shown in FIG. 5, a laterally extending outer attachment plate 115 couples the outer end portions of the roof panels 12 to the upper end portions of the side wall panels 14, and is also formed in longitudinally continuous sections. The upper portion of each section of the outer attachment plate 115 is connected by bolts 116 to "Rivnuts" 112 secured to the overlapping portions of the eve spacer member 46 and end flanges of the longitudinal spacer members 32 of each roof panel 12. The lower portion of each section of the outer attachment plate 115 is secured by bolts 116 which are threaded into "Rivnuts" 112 secured to the upper spacer members 58 and 68 of each wall panel 14 and to the outer skin 56.

Referring to FIGS. 9–13, embodiment of a sheet metal building constructed in accordance with the invention provides for a flat ceiling. As shown by the end view of the building in FIG. 9 with the end walls removed, a plurality of assembled rectangular roof panels 120 are arranged in succession with each roof panel 120 spanning between a set of parallel spaced side walls each constructed of a plurality of rectangular wall panels 122 mounted upon plates secured to concrete floor 124. The roof panels 120 are constructed to span a space, for example, up to approximately 40 feet.

Each of the roof panels 120 includes a pair of formed sheet metal longitudinal spacers 126 (FIG. 12), and each spacer member 126 tapers or has an increasing height to form a center ridge portion 128 and a pitch of less than twelve degrees, for example, on the order of three degrees. The inner end portions of opposing longitudinal spacers 126 overlap within the ridge portion 128 and are rigidly secured together by suitable fasteners. Thus the bottom ribbed flange 131 of each longitudinal spacer 126 extends horizontally while the upper ribbed flange 131 of each longitudinal spacer 126 slopes downwardly towards the outer end of the spacer 126.

The tapering longitudinal spacers 126 of each roof panel 120 are rigidly connected by a series of laterally extending parallel sheet metal spacers 134 which are arranged at longitudinally spaced intervals. The height of each lateral spacer 134 corresponds to the height of the longitudinal spacers at the location of the spacer 134. The parallel longitudinal spacers 126 of each tapered roof panel 120 are also rigidly connected at the ridge portion 128 by a ridge spacer 136 (FIG. 11) which is also formed of sheet metal and has an inverted U-shaped cross-sectional configuration. The ridge spacer 136 has a top wall 137 and end flanges 138 which are secured to the parallel longitudinal spacers 126.

Figure 11:
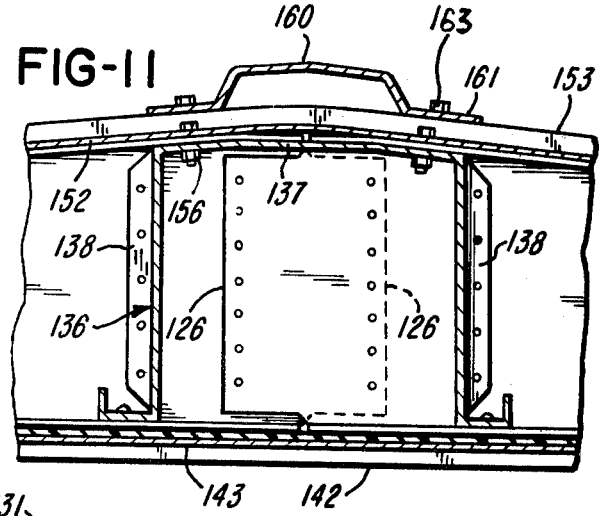
FIG. 11 is an enlarged fragmentary section through a ridge portion of the building shown in FIG. 9.
Figure 12:
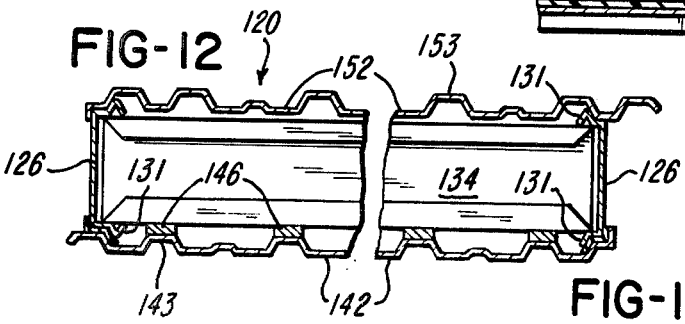
FIG. 12 is an enlarged cross-section of a typical roof panel used in the building shown in FIG. 9 and with a center portion broken away.
Figure 13:
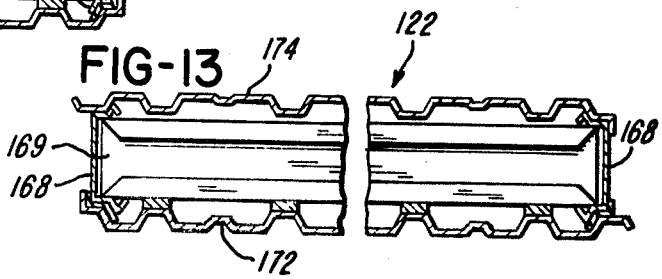
FIG. 13 is an enlarged cross-section of a typical wall panel used in the building shown in FIG. 9 and with a center portion broken away.

Each of the roof panels 120 further includes a bottom or inner sheet metal skin 142 which extends the full length of the roof panel and has parallel spaced longitudinally extending ribs 143 (FIG. 12). The ribs 143 project upwardly and are secured by fasteners to the spacers 126, 134 and 136 by fasteners, and thermal insulation strips 146 are clamped between the inner skin 142 and the roof panel spacers to minimize heat conduction through the roof panels. Each of the roof panels 120 also includes an upper or outer sheet metal skin 152 which has upwardly projecting and longitudinally extending ribs 153 (FIG. 12). The center portion of the outer skin 152 of each roof panel 120 is bent (FIG. 11) along the ridge portion and is secured to the inner ridge spacer 136 by fasteners 156. The outer skin 152 of each roof panel 120 has substantially the same cross-sectional configuration as the inner skin 142 so that both skins may be roll-formed with the same tooling on a rolling mill.

Figure 9:
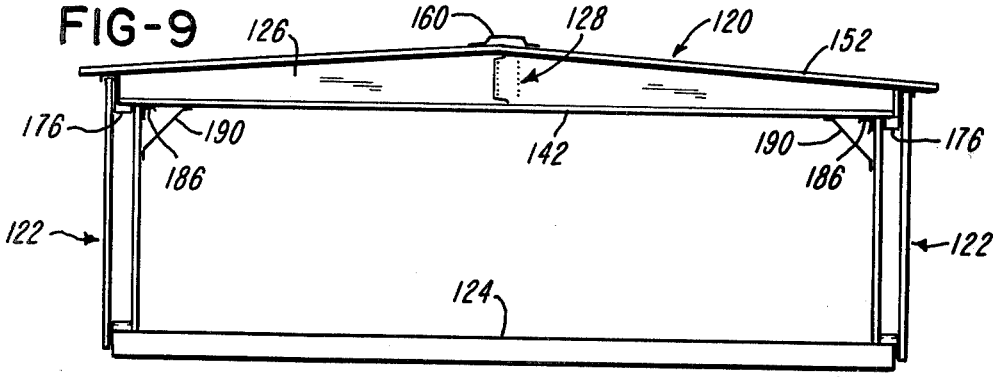
FIG. 9 is an end elevation view similar to FIG. 1 and showing a modified metal building constructed in accordance with the invention.

As shown in FIGS. 9 and 11, a continuous external ridge beam 160 extends along the ridge portion of the assembled roof panels 120 and is formed of a relatively heavy gauge sheet metal. The outer parallel flanges 161 of the ridge beam 160 are rigidly secured by fasteners 163 to the inner ridge spacer 136 of each roof panel 120. The fasteners 163 also extend through aligned holes within the outer roof skins 152 and top flanges of the spacers 126 of the longitudinally arranged roof panels 120. The continuous external ridge beam 160 functions in a manner similar to the internal ridge beam 78 described above in connection with FIGS. 1–4, that is, to distribute loading along the roof panels 120 longitudinally of the building and to facilitate assembly of the roof panels 120.

Figure 10:
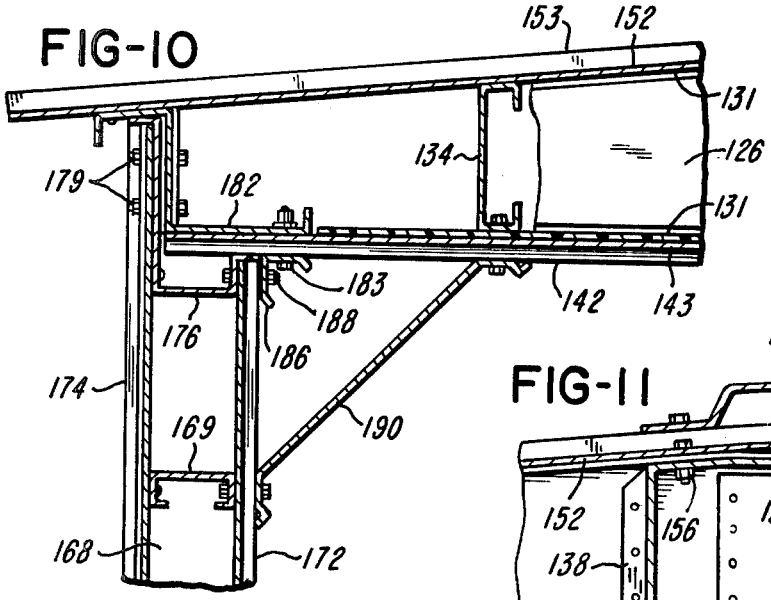
FIG. 10 is an enlarged fragmentary section through an eve portion of the building shown in FIG. 9.

The wall panels 122 of the building shown in FIGS. 9 and 10, are constructed similar to the wall panels 14 described above in connection with FIG. 7. That is, each of the wall panels 122 includes vertically extending sheet metal longitudinal spacers 168 (FIG. 13), vertically spaced and horizontally extending lateral spacers 169, an inner corrugated sheet metal skin 172 and an outer corrugated sheet metal skin 174. A lateral spacer 176 forms the upper end of each wall panel 122 and has generally a Z-shaped cross-sectional configuration. When the roof panels 120 are assembled to the wall panels 122, a set of fasteners 179 extend through the outer skin 174 of each wall panel 122 and through aligned holes within the upper lateral spacer 176 and within a Z-shaped lateral spacer 182 within the outer end portion of the overlying roof panel 120.

As also shown in FIG. 10, when the roof panels 120 are assembled to the wall panels 122, the bottom flange of each lateral spacer 182 within each roof panel 120 is attached by fasteners 183 to the upper flange of an inner angular metal corner plate 186 which extends the full length of the building. The vertical flange of the plate 186 is attached by fasteners 188 to the upper lateral spacer 176 within each of the wall panels 122. The roof panels 120 are also attached to the wall panels 122 by an inner attachment plate 190 which is inclined and extends the full length of the building in the same manner as described above in connection with the inner attachment plate 105 shown in FIG. 5.

Figure 14:
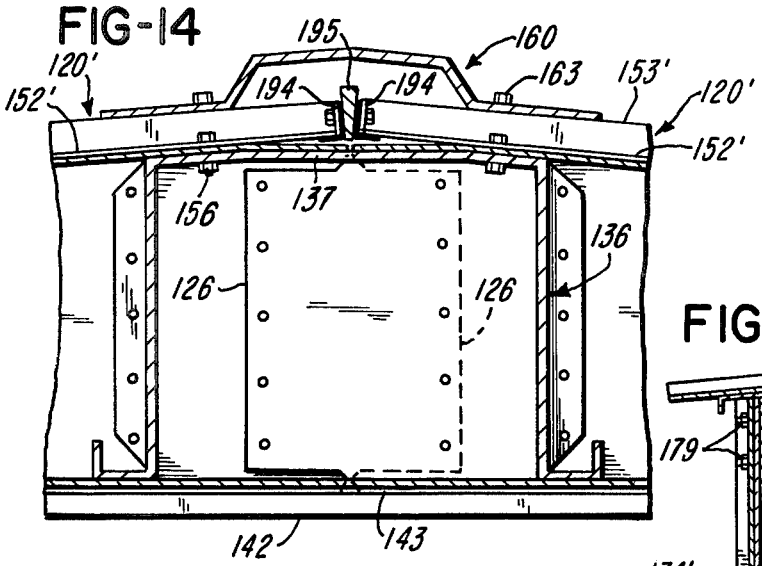
FIG. 14 is a view similar to FIG. 11 and showing a modified ridge portion of a metal building constructed in accordance with the invention.

FIG. 14 illustrates a modification of assembled roof panels 120' which are constructed similar to the roof panels 120 with the exception that each roof panel 120' includes a pair of opposing outer skins 152' instead of a single outer skin 152 which is bent along the ridge portion 128. In the embodiment of FIG. 14, each of the outer skins 152' has an inner flange 194, and a tapered wedge member 195 is placed between the inner flanges 194 for transmitting compression loads or forces in the same manner as the wedge member 96 described above in connection with FIG. 4. When the sheet metal outer skins 152' are roll formed from high tensile sheet steel which is almost full hard, the corrugations or ribs 153' do not permit practical bending of the outer skins. It is also apparent from the modification shown in FIG. 14 that the external ridge beam 160 also forms a cover for the wedge member 195, and that the upper wall 137 of the ridge spacer 136 within each roof panel 120' also cooperates to transmit compression loads across the ridge portion 128 and between the outer skins 152'.

Figure 15:
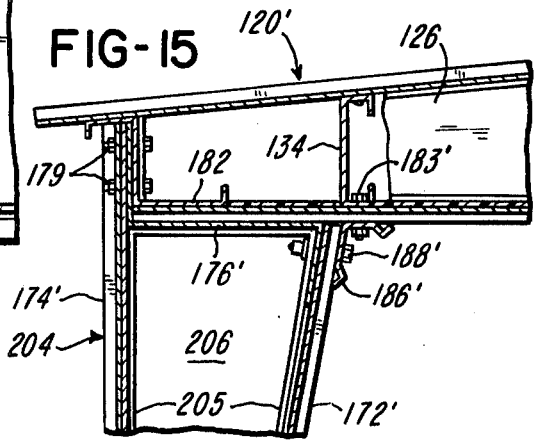
FIG. 15 is a view similar to FIG. 10 and showing a roof panel attached to a tapered wall panel in accordance with the invention.

Referring to FIG. 15 which shows another modification of a metal building constructed in accordance with the invention, a plurality of tapered roof panels 120' extend or span between parallel side walls each of which is formed by a plurality of tapered rectangular wall panels 204. Each of the wall panels 204 is constructed similar to the wall panels 122 with the exception that the flanges 205 of the longitudinal spacers 206 converge towards the bottom of the panel, thus requiring different width laterally extending spacers between the inner sheet metal skin 172' and the outer sheet metal skin 174'.

The top Z-shaped lateral spacer 176' (FIG. 15) is attached by fasteners 188' to one flange of the panel attachment angle or plate 186', and the upper flange of the attachment plate 186' is attached by fasteners 183' to the bottom flanges of the longitudinal spacers 126 and lateral spacers 134 as well as the inner skins 142 of the roof panels 120'. By using the tapered sidewall panels 204 shown in FIG. 15, the inclined attachment plates 190 are eliminated for coupling the roof panels 120 to the wall panels 204. While FIG. 15 shows the outer skins 174' in a vertical position and the inner skins 172' in an inclined position, it is apparent that the wall panels may be constructed with the inner skins 172' vertically and the outer skins 174 inclined or sloping outwardly if it is desired for the building to have vertical inner wall surfaces.

Figure 16:
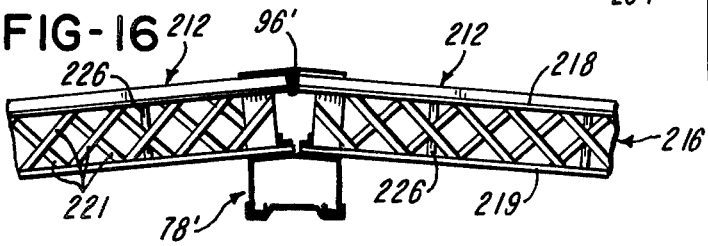
FIG. 16 is a view similar to FIG. 4 and showing roof panels constructed with open lattice-type longitudinal members in accordance with the invention.

FIG. 16 shows diagrammatically a roof system which is constructed and assembled similar to the roof system described above in connection with FIG. 4 and which includes prefabricated roof panels 212 coupled together across the ridge by a lower or inner ridge beam 78' and an upper wedge member 96'. The primary difference between each roof panel 212 and the roof panels 12 is that each roof panel 212 includes a pair of longitudinal spacers 216 of open lattice-type construction. That is, each longitudinal spacer 216 includes an upper flange 218 and a lower flange 219 which are rigidly connected by formed sheet metal crossing struts 221. The pair of longitudinal spacers 216 of each roof panel 212 are rigidly connected by lateral spacers 226 which are constructed in the same manner as the longitudinal spacers 216. The lattice-type construction for the spacers 216 and 226 provides for significantly increasing the thickness or height and strength of the roof panels 212 while minimizing their weight so that the assembled roof panels 212 may span a greater width without having intermediate support columns for the roof panels.

Figure 17:
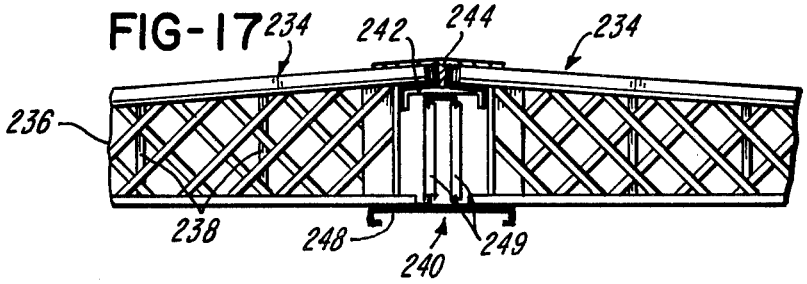
FIG. 17 is a view similar to FIG. 11 and showing tapered roof panels constructed with open lattice-type longitudinal members in accordance with the invention.

The modified roof assembly illustrated in FIG. 17 incorporates a plurality of roof panels 234 each of which is constructed similar to the roof panel 212 described above in reference to FIG. 16, that is, with open lattice-type longitudinal spacers 236 and lateral spacers 238. The longitudinal spacers 236 taper with an increasing height towards the ridge, and the lateral spacers 238 progressively increase in height towards the ridge so that the assembled tapered roof panels 234 provide the roof assembly with a flat inner surface or ceiling.

The roof panels 234 are rigidly connected along and across the ridge by a fabricated sheet-metal ridge beam 240 which extends continuously along the length of the metal building. The ridge beam 240 has a top flange 242 which connects the upper portions of the roof panels 234 with longitudinally spaced fasteners extending through the outer sheet metal skins, the adjacent lateral spacers 238 and the inner ends of the top flanges of the longitudinal spacers 236. A wedge member 244 also extends longitudinally along the ridge in a manner as described above in connection with the embodiment shown in FIG. 4 for transferring compression forces or loads across the ridge.

The ridge beam 240 also has a lower flange 248 which connects the inner skins of roof panels 234, the inner ends of the longitudinal spacers 236 and the inner lateral spacers 238 of the roof panels 234 for transmitting tension forces across the bottom of the ridge and for distributing loads on one roof panel 234 to its longitudinally adjacent roof panels. The top flange 242 and the bottom flange 246 of the ridge beam 240 are rigidly connected by an open lattice-type arrangement of crossing struts 249 each of which is preferably formed of roll-formed sheet metal strip.

Figure 18:
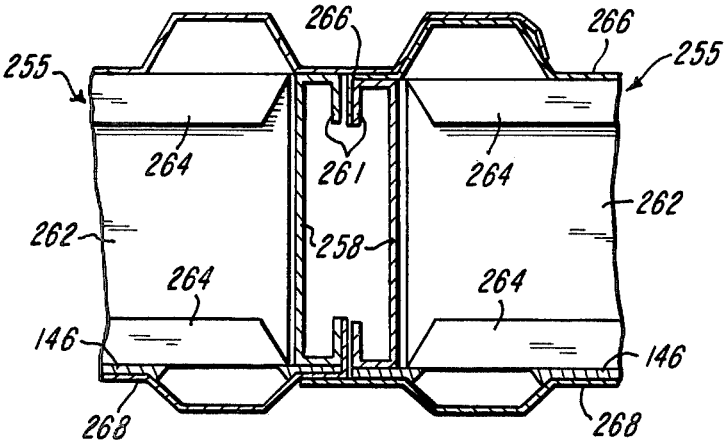
FIG. 18 is a section view similar to FIG. 6 and showing a modified roof panel connection in accordance with the invention.

FIG. 18 shows a joint connection between a pair of roof panels 255 which are constructed similar to the roof panels 120 described above in connection with FIG. 12. Each of the modified roof panels 255 includes a pair of longitudinal spacers 258 each of which has a channel-like cross-sectional configuration with opposing return lip flanges 261. Similarly, each of the lateral sheet metal spacers 262 has a similar cross-sectional configuration including return lip flanges 264. The roll-formed sheet metal outer skin 266 and inner skin 268 of each roof panel 255 are substantially the same as the corresponding skins of each roof panel 120. The return lip flanges of the longitudinal spacers 258 project outwardly along opposite sides of each roof panel 255, whereas the lip flanges of the longitudinally extending spacers 126 of the roof panels 120 project inwardly along the opposite sides of each roof panel. In most roof assemblies, it is desirable for the roof panels to incorporate longitudinal spacers having outwardly projecting return flanges as shown in FIG. 18 to provide the maximum strength/weight ratio and to allow outside fastening access, particularly for spot welding or bolting. strength/weight ratio.

From the drawings and the above description, it is apparent that a metal building constructed in accordance with the present invention, provides desirable features and advantages. For example, after the roof panels and wall panels are assembled as described above, the assembled panels have a combined total strength substantially higher than the strength of each panel per se times the number of panels. This higher total strength of the assembled panels results primarily from using the inherent strength of the sheet metal skins and the transmission of any concentrated load in one panel or group of panels to the laterally adjacent and/or opposing panels through the longitudinally extending ridge beam and attachment plates. Furthermore, the coupling of the roof panels across the ridge by means of the ridge member or plate and the wedge member along with the fasteners, provides for utilizing the high tensile strength of the inner sheet metal roof skins and the high compression strength of the outer roof skins for carrying the loads. In addition, as mentioned above, the wedge member compensates for accumulated tolerances in the manufacture and assembly of the roof panels.

Another important feature of a building constructed in accordance with the invention is provided by the coupling of the roof panels to the wall panels by means of the inner attachment plates and the outer attachment plates. These attachment plates function to transfer the stress or loads from the roof panels to the wall panels and to utilize the inner and outer skins of the wall panels to resist bending of the roof panels. Thus the construction and assembly of the roof and wall panels effectively utilizes the inherent strength of the sheet metal skins of the panels and thereby eliminates the need for a frame and its cost of erection along with the need for roof purlins and wall girts.

Since the sheet metal used for forming the longitudinally and laterally extending spacer members within the roof panels and wall panels is of substantially lighter gauges than are commonly used for forming roof purlins and wall girts for a conventional metal building of the same size, the total weight of a building constructed in accordance with the invention is significantly lower than the total weight of a conventional metal building of the same size. As a result, the cost of metal used in constructing a building of the invention is significantly lower than the cost of the metal used in a conventional metal building. The relatively light weight of the roof panels and wall panels, for example, less than 160 pounds per panel for a building having a width of 42 feet, also provides for a simple and quick erection of the building without the need for a crane.

The prefabrication of the roof panels and wall panels also permits quick assembly of the panels, beginning at one end of the building and progressing towards the opposite end. The precise placement of the prepunched holes in the ridge and eave members also assures positive location of the panels and permits erection of the building by labor less skilled than the labor normally required for conventional metal buildings. It is also apparent that the roof and wall panels may enclose a thermal insulation material when desired.

Additional important features are provided by the modifications illustrated in FIGS. 9–18. For example, these modifications provide for constructing a frameless metal building with a flat ceiling and may be used to provide a clear-span roof assembly of substantial width. The greatest clear-span roof width is provided by the roof assembly shown in FIG. 17 and may be over one hundred feet.

While the forms of building structures and their methods of construction and assembly herein described constitute preferred embodiments of the invention, it is to be understood that the invention is not limited to these precise forms, and that changes may be made therein without departing from the scope and spirit of the invention as defined in the appended claims.

The invention having thus been described, the following is claimed:

1. A frameless building comprising a plurality of generally rectangular roof panels, each of said roof panels including an inner sheet metal skin portion and an outer sheet metal skin portion, each said skin portion having a corrugated cross-sectional configuration, a series of spacers rigidly connected to said skin portions of each said roof panel, means forming spaced opposite side walls for said building, said roof panels being secured together in adjacent relation to form a roof assembly extending between said opposite side walls, said spacers within each said roof panel including tapering longitudinal spacers positioning said inner skin portion substantially horizontally to provide said roof assembly with a substantially flat inner ceiling, said outer skin portions being inclined upwardly from said side walls at an angle less than twelve degrees and defining a peaked ridge portion extending parallel between said side walls, means rigidly connecting said inner skin portions of said roof panels along said ridge portion and being effective to transfer tension forces laterally across the lower part of said ridge portion, means rigidly connecting said outer skin portions of said roof panels along said ridge portion and effective to transfer compressive forces laterally across the upper part of said ridge portion, and means for rigidly connecting said roof panels to said side walls for transferring loads from said roof panels through said side walls to a base supporting said side walls.

2. A building as defined in claim 1 wherein each of said longitudinal spacers includes upper and lower converging flanges rigidly connected by an open lattice-type arrangement of crossing struts.

3. A building as defined in claim 1 wherein said means rigidly connecting said outer skin portions of said roof panels comprise a tapered element disposed between the opposing inner end surfaces of said outer skin portions located on opposite sides of said ridge portion.

4. A building as defined in claim 1 wherein said spacers within each of said roof panel include longitudinal spacers disposed generally parallel on opposite side of said ridge portion, and said longitudinal spacers have corresponding inner end portions rigidly connected within said ridge portion of said roof assembly.

5. A building as defined in claim 1 wherein said inner and outer sheet metal skin portions of each of said roof panels include parallel spaced longitudinally extending ribs forming substantially the same corrugated cross-sectional configuration, and said ribs of said inner and outer skin portions project in opposite directions relative to said spacers between said skin portions.

6. A building as defined in claim 1 wherein each of said side walls is formed by a plurality of wall panels including inner and outer sheet metal skin portions, a series of spacers rigidly connected to said skin portions of each said wall panel, said spacers including a series of longitudinally spaced lateral spacers, and means for rigidly securing said inner and outer skin portions and said spacers of each said wall panel to said inner skin portion and said spacers of an overlying said roof panel.

7. A building as defined in claim 1 wherein said means rigidly connecting said inner skin portions of said roof panels along said ridge portion comprise integral center sections of said inner skin portions.

8. A frameless building comprising a plurality of generally rectangular roof panels, each of said roof panels including a substantially flat inner sheet metal skin portion and a substantially flat outer sheet metal skin portion, said skin portions having longitudinally extending spaced ribs, sheet metal means extending generally perpendicular to said inner and outer skin portions of each said roof panel and rigidly connecting said skin portions with said outer skin portion spaced from said inner skin portion, means forming spaced opposite side walls for said building, said roof panels being secured together in adjacent relation to form a roof assembly extending between said opposite side walls, said outer skin portions being inclined upwardly from said side walls and defining a peaked ridge portion extending parallel between said side walls, means rigidly connecting said inner skin portions of said roof panels along said ridge portion and being effective to transfer tension forces laterally across the lower part of said ridge portion, means rigidly connecting said outer skin portions of said roof panels along said ridge portion and being effective to transfer compressive forces laterally across the upper part of said ridge portion, and means for rigidly connecting said roof panels to said side walls for transferring loads from said roof panels through said side walls to a base supporting said side walls.

9. A building as defined in claim 8 wherein said roof panels include corresponding lateral ridge spacers each having a top wall integrally connecting horizontally spaced side walls to form generally an inverted U-shaped cross-sectional configuration, and means rigidly connecting said top walls of said ridge spacers to the corresponding said outer skins portions of said roof panels.

10. A building as defined in claim 8 wherein said means rigidly connecting said outer skin portions of said roof panels include an elongated ridge beam extending longitudinally of the building along said ridge portion and above said outer skin portions.

11. A building as defined in claim 8 wherein each said roof panel includes longitudinal spacers each having a channel-like cross-sectional configuration with longitudinally extending return lip flanges projecting outwardly along opposite sides of said roof panel.

12. A building as defined in claim 8 wherein each of said roof panels has an outer end portion including a lateral spacer having generally a Z-shaped cross-sectional configuration, and fastener means connecting each said lateral spacer to the adjacent side wall.

13. A building as defined in claim 8 wherein said means rigidly connecting said outer skin portions of said roof panels include a tapered wedge-like element extending longitudinally of the building and disposed generally between opposing inner end surfaces of said outer skin portions positioned on opposite sides of said ridge portion.

14. A building as defined in claim 8 wherein each roof panel includes longitudinal spacers having upper and lower flanges rigidly connected by an open lattice-type arrangement of crossing struts.

15. A building as defined in claim 8 wherein said means rigidly connecting said inner skin portions of said roof panels along said ridge portion include an elongated ridge beam extending longitudinally of the building and disposed between the opposing said roof panels located on opposite sides of said ridge portion.

16. A frameless building comprising a plurality of elongated roof panels and elongated wall panels, each of said roof and wall panels including a substantially flat inner sheet metal skin portion and a substantially flat outer sheet metal skin portion, said skin portions having longitudinally extending spaced ribs, sheet metal means extending generally perpendicular to said inner and outer skin portions of each said roof and wall panel and rigidly connecting said skin portions with said outer skin portion spaced from said inner skin portion, said wall panels being secured together in adjacent relation to form spaced opposite side walls for said building, said roof panels being secured together in adjacent relation to form a roof assembly extending between said opposite side walls, said outer skin portions of said roof panels being inclined upwardly from said side walls and defining a peaked ridge portion extending parallel between said side walls, means rigidly connecting said inner skin portions of said roof panels along said ridge portion and being effective to transfer tension forces laterally across the lower part of said ridge portion, means rigidly connecting said outer skin portions of said roof panels along said ridge portion and being effective to transfer compressive forces laterally across the upper part of said ridge portion, and means for rigidly connecting said roof panels to said wall panels for transferring loads from said roof panels through said wall panels to a base supporting said wall panels and for utilizing said wall panels to resist bending of said roof panels.

17. A building as defined in claim 16 wherein said inner and outer sheet metal skin portions of said wall panels include parallel spaced longitudinally extending ribs forming substantially the same corrugated cross-sectional configuration.

18. A building as defined in claim 16 wherein said outer skin portion of each said wall panel projects above the corresponding said inner skin portion for receiving the outer end portion of an overlying said roof panel.

19. A building as defined in claim 16 wherein said inner and outer skin portions of each said wall panel have upper end surfaces disposed at different elevations for receiving the outer end portion of an overlying said roof panel.

20. A building as defined in claim 16 wherein each of said wall panels includes a pair of tapered longitudinal spacers for positioning the corresponding said inner and outer skin portions in diverging relation, and each said wall panel has its greatest thickness adjacent the overlying said roof panel.

21. A frameless building comprising a plurality of generally rectangular roof panels, each of said roof panels including a substantially flat inner sheet metal skin portion and a substantially flat outer sheet metal skin portion, said skin portions having longitudinally extending spaced ribs, sheet metal means extending generally perpendicular to said inner and outer skin portions of each said roof panel and rigidly connecting said skin portions with said outer skin portion spaced from said inner skin portion, means forming spaced opposite side walls for said building, said roof panels being secured together in adjacent relation to form a roof assembly extending between said opposite side walls, said outer skin portions being inclined upwardly from said side walls and defining a peaked ridge portion extending parallel between said side walls, an elongated ridge beam extending longitudinally of the building along said ridge portion, means associated with said ridge beam for rigidly connecting said inner skin portions of said roof panels along said ridge portion and being effective to transfer tension forces laterally across the lower part of said ridge portion, means rigidly connecting said outer skin portions of said roof panels along said ridge portion and being effective to transfer compressive forces laterally across the upper part of said ridge portion, and means for rigidly connecting said roof panels to said side walls for transferring loads from said roof panels through said side walls to a base supporting said side walls.

22. A frameless building comprising a plurality of elongated roof panels and elongated wall panels, each of said roof and wall panels including a substantially flat inner sheet metal skin portion and a substantially flat outer sheet metal skin portion, said skin portions having longitudinally extending spaced ribs, means rigidly connecting said inner and outer skin portions of each of said roof and wall panels and spacing said outer skin portion from said inner skin portion, said wall panels being secured together in adjacent relation to form spaced opposite side walls for said building, said roof panels being secured together in adjacent relation to form a roof assembly extending between said opposite side walls, said means connecting and spacing said skin portions of said panels including generally parallel spaced longitudinally extending sheet metal walls rigidly connected by longitudinally spaced laterally extending sheet metal walls, said outer skin portions of said roof panels being inclined upwardly from said side walls and defining a peaked ridge portion extending parallel between said side walls, means rigidly connecting said inner skin portions of said roof panels along said ridge portion and being effective to transfer tension forces laterally across the lower part of said ridge portion, means rigidly connecting said outer skin portions of said roof panels along said ridge portion and being effective to transfer compressive forces laterally across the upper part of said ridge portion, and means for rigidly connecting said roof panels to said wall panels for transferring loads from said roof panels through said wall panels to a base supporting said wall panels and for utilizing said wall panels to resist bending of said roof panels.

23. A building as defined in claim 22 and including a set of inclined attachment panels rigidly connecting said skin portions of said roof panels to said skin portions of said wall panels.

24. A frameless building comprising a plurality of generally rectangular roof panels, each of said roof panels including a substantially flat inner sheet metal skin portion and a substantially flat outer sheet metal skin portion, said skin portions having longitudinally extending spaced ribs, sheet metal means extending generally perpendicular to said inner and outer skin portions of each said roof panel and rigidly connecting said skin portions with said outer skin portion spaced substantially parallel to said inner skin portion, means forming spaced opposite side walls for said building, said roof panels being secured together in adjacent relation to form a roof assembly extending between said opposite side walls, said outer skin portions being inclined upwardly from said side walls at an angle less than twelve degrees and defining a peaked ridge portion extending parallel between said side walls, means rigidly connecting said inner skin portions of said roof panels along said ridge portion and being effective to transfer tension forces laterally across the lower part of said ridge portion, means rigidly connecting said outer skin portions of said roof panels along said ridge portion and being effective to transfer compressive forces laterally across the upper part of said ridge portion, and means for rigidly connecting said roof panels to said side walls for transferring loads from said roof panels through said side walls to a base supporting said side walls.

* * * * *